US007617041B2

(12) United States Patent
Sera

(10) Patent No.: US 7,617,041 B2
(45) Date of Patent: Nov. 10, 2009

(54) TRAFFIC JAM PREDICTION DEVICE AND METHOD

(75) Inventor: Manabu Sera, Chigasaki (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 367 days.

(21) Appl. No.: 11/476,384

(22) Filed: Jun. 28, 2006

(65) Prior Publication Data

US 2007/0005230 A1 Jan. 4, 2007

(30) Foreign Application Priority Data

Jun. 29, 2005 (JP) ..... 2005-189702

(51) Int. Cl.
*G08G 1/00* (2006.01)

(52) U.S. Cl. ..... 701/119

(58) Field of Classification Search ..... 701/117–119
See application file for complete search history.

(56) References Cited

U.S. PATENT DOCUMENTS

| | | | | | |
|---|---|---|---|---|---|
| 5,428,544 | A * | 6/1995 | Shyu | 701/117 |
| 5,539,645 | A * | 7/1996 | Mandhyan et al. | 701/119 |
| 5,589,827 | A * | 12/1996 | Scurati | 340/901 |
| 5,696,503 | A * | 12/1997 | Nasburg | 340/933 |
| 5,933,100 | A * | 8/1999 | Golding | 340/995.13 |
| 5,987,374 | A * | 11/1999 | Akutsu et al. | 701/117 |
| 6,012,012 | A * | 1/2000 | Fleck et al. | 701/117 |
| 6,131,064 | A * | 10/2000 | Vieweg | 701/117 |
| 6,150,961 | A * | 11/2000 | Alewine et al. | 340/995.1 |
| 6,236,933 | B1 * | 5/2001 | Lang | 701/117 |
| 6,438,490 | B2 * | 8/2002 | Ohta | 701/210 |
| 6,466,862 | B1 * | 10/2002 | DeKock et al. | 701/117 |
| 6,490,519 | B1 * | 12/2002 | Lapidot et al. | 701/117 |
| 6,510,377 | B2 * | 1/2003 | Phung et al. | 701/117 |
| 6,546,330 | B2 * | 4/2003 | Fushiki et al. | 701/118 |
| 6,594,576 | B2 * | 7/2003 | Fan et al. | 701/117 |
| 6,708,107 | B2 * | 3/2004 | Impson et al. | 701/117 |
| 6,711,493 | B1 * | 3/2004 | Andrews et al. | 701/117 |
| 6,842,620 | B2 * | 1/2005 | Smith et al. | 455/456.1 |
| 6,845,316 | B2 * | 1/2005 | Yates | 701/117 |
| 7,050,903 | B1 * | 5/2006 | Shutter et al. | 701/117 |
| 7,116,326 | B2 * | 10/2006 | Soulchin et al. | 345/440 |
| 7,203,595 | B1 * | 4/2007 | Auxer et al. | 701/117 |
| 7,228,224 | B1 * | 6/2007 | Rosen et al. | 701/117 |
| 7,454,288 | B2 * | 11/2008 | Parikh et al. | 701/117 |
| 2002/0077742 | A1 * | 6/2002 | Mintz | 701/117 |
| 2002/0082767 | A1 * | 6/2002 | Mintz | 701/117 |

(Continued)

FOREIGN PATENT DOCUMENTS

| | | |
|---|---|---|
| CN | 1576790 A | 2/2005 |

(Continued)

*Primary Examiner*—Thomas G Black
*Assistant Examiner*—Ari M Diacou
(74) *Attorney, Agent, or Firm*—Young Basile

(57) ABSTRACT

A device and method to enable the prediction of a traffic jam even when the road environment changes. On the basis of up-to-the-minute, i.e., current, traffic jam information and changes from the preceding traffic jam information, the current traffic state is estimated. On the basis of the up-to-the-minute traffic jam information and the current traffic state, the current traffic jam degree is predicted. The results can be used in a conventional navigation method and apparatus to plot driving routes for a vehicle.

20 Claims, 2 Drawing Sheets

U.S. PATENT DOCUMENTS

2003/0009277 A1* 1/2003 Fan et al. ..... 701/117
2004/0143385 A1* 7/2004 Smyth et al. ..... 701/117
2005/0027448 A1* 2/2005 Takenaga et al. ..... 701/211
2005/0140525 A1* 6/2005 Tomita et al. ..... 340/995.13
2006/0055565 A1* 3/2006 Kawamata et al. ..... 340/995.13
2007/0208501 A1* 9/2007 Downs et al. ..... 701/119

FOREIGN PATENT DOCUMENTS

JP 2004-272408 9/2004

* cited by examiner

TRAFFIC JAM PREDICTION DEVICE AND METHOD

TECHNICAL FIELD

The present invention pertains to a traffic jam prediction device and a traffic jam predicting method for predicting traffic jams on roads.

BACKGROUND

A traffic jam prediction system has been proposed in, for example, Japanese Kokai Patent Application No. 2004-272408. In this system, on the basis of the preceding traffic jams information for each link provided by the traffic information center, the correlation data of traffic jam between the traffic jam pattern and the link is prepared for each link, and a traffic jam at any link can be predicted.

BRIEF SUMMARY OF THE INVENTION

Embodiments of the invention provide a traffic jam prediction device and method. One device taught herein, for example, receives traffic jam information from a traffic information center. The device can include a controller operable to estimate a current traffic state of a road link based on current traffic jam information and a change from preceding traffic jam information. The controller is also operable to predict a current traffic jam degree of the road link based on the current traffic jam information and the current traffic state as estimated.

Another example of a traffic jam prediction device taught herein comprises traffic state estimating means for estimating a current traffic state based on current traffic jam information and a change from preceding traffic jam information and traffic jam degree predicting means for predicting a degree of a current traffic jam based on the current traffic jam information and the current traffic state from the traffic state estimating means.

Methods for predicting traffic jams are also taught herein. One aspect of a traffic jam prediction method comprises, for example, estimating a current traffic state based on current traffic jam information and a change from preceding traffic jam information and predicting a current traffic jam degree based on the current traffic jam information and the current traffic state.

Other aspects and features of the various devices and methods according to the invention are described in more detail hereinafter.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

In the conventional traffic jam prediction system described above, the traffic jam correlation data between the traffic jam pattern and each link are prepared from the preceding traffic jam information provided by the traffic information center. In the case of establishing a new facility or a change in the road environment due to enforcement of a new traffic control rule, because there is no accumulation of traffic jam information after the change in the road environment, it subsequently becomes difficult to predict traffic jams. This is undesirable.

According to embodiments of the invention, it is possible to make a correct prediction of the traffic jam degree even when the road environment has changed.

More specifically, a traffic jam prediction device as described herein receives traffic jam information from the traffic information center. The current traffic state is estimated on the basis of the up-to-the-minute traffic jam information and the change from the preceding traffic jam information received from the traffic information center. The degree of the current traffic jam is predicted on the basis of the up-to-the-minute traffic jam information and the current traffic state.

In the traffic jam prediction device of the information center, the traffic jam degree for each road link is obtained from plural vehicles. This information is collected to generate traffic jam information that is sent to the various vehicles. In this device, the current traffic state is estimated on the basis of the up-to-the-minute traffic jam information and the change from the preceding traffic jam information, and the current traffic jam degree is predicted on the basis of the up-to-the-minute traffic jam information and the current traffic state.

Figure 1:
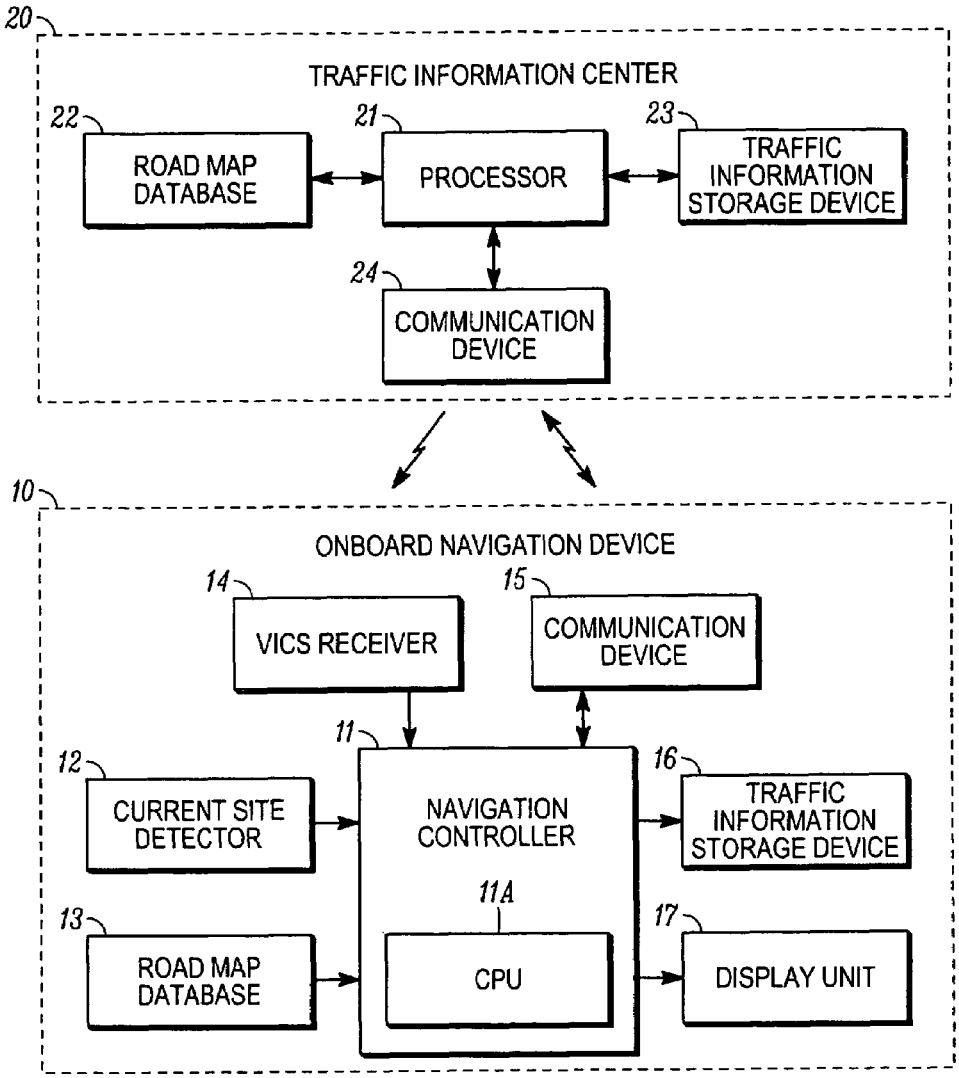
FIG. 1 is a diagram illustrating an embodiment according to the invention.

Embodiments of the invention are further illustrated with respect to the drawing figures. FIG. 1 is a diagram illustrating an embodiment of the invention. In this embodiment, onboard navigation device 10 searches the shortest-time route to a destination, displays the road map around the vehicle and displays the guiding path and the current site, or location, on the road map so as to guide the driver to the destination. Onboard navigation device 10 communicates with traffic information center 20 to exchange road traffic information. That is, plural vehicles each carrying an onboard navigation device 10 function as probe vehicles to collect road traffic information and send the information to traffic information center 20. In traffic information center 20, the road traffic information sent from the plural vehicles is collected and distributed to the various vehicles. The road traffic information contains the traffic jam information and the traffic control information discussed in more detail hereinbelow.

As shown, onboard navigation device 10 has the following parts: navigation controller 11, current site detector 12, road map database 13, VICS receiver 14, communication device 15, traffic information storage device 16 and display unit 17. Current site detector 12 incorporates a GPS receiver and can detect the current site of the vehicle by means of a satellite navigation method. One may alternately or in addition thereto adopt a scheme in which a travel distance sensor and a movement direction sensor are set, and the current site is detected using the self-governing navigation method on the basis of the travel distance and movement direction of the vehicle.

Road map database 13 is a conventional storage device that stores the road map data, and it may be integrated as part of the navigation controller 11. VICS receiver 14 receives FM multiplex broadcast, electromagnetic wave beacon and/or light beacon signals to get traffic jam information, traffic control information, etc. Communication device 15 accesses traffic information center 20 via public telephone lines from a cell phone or onboard phone to get the road traffic information. The road traffic information obtained from traffic information center 20 contains the traffic jam information and traffic control information.

Traffic information storage device 16 is a storage device that stores the road traffic information obtained from traffic information center 20. Like road map database 13, traffic information storage device 16 can also be integrated with the navigation controller 11. As shown in Table 1, the traffic jam information provided by traffic information center 20 via electromagnetic wave or light beacon broadcasts and public telephone lines to onboard navigation device 10 presents the "speed code" or "average speed" at each cross point, etc., as a node, and it determines the speed range and average speed corresponding to each code.

TABLE 1

| Code | Speed range (km/h) | Average speed (km/h) |
|---|---|---|
| 70 | 0~15 | 7.5 |
| 71 | 15~25 | 20 |
| 72 | 25~35 | 30 |
| 73 | 35~45 | 40 |
| 74 | 45~55 | 50 |
| 75 | 55~65 | 60 |
| 76 | 65~75 | 70 |

Onboard navigation device 10 uses a node-link corresponding table in road map database 13 to convert the traffic jam information at the node into the traffic jam information of the link and stores it in traffic information storage device 16. Also, the traffic jam information of traffic information center 20 is distributed after a prescribed time (e.g., about 5 min).

Traffic information center 20 as shown in FIG. 1 has processor 21, road map database 22, traffic information storage device 23 and communication device 24. Processor 21 receives the road traffic information from onboard navigation device 10 carried on each of plural vehicles via communication device 24, collects the information so obtained and stores it in traffic information storage device 23. At the same time, it distributes the information via communication device 24 to respective onboard navigation devices 10 for each of the plural vehicles. Road map database 22 is a storage device that stores the road map data.

The navigation controller 11 of the onboard navigation device 10, and particularly its CPU 11A, or processor 21 of the traffic information center 20, perform the functions of estimating traffic information and predicting a traffic jam degree, i.e., a degree of traffic jam, as discussed in more detail next. As shown in FIG. 1, CPU 11A is part of the navigation controller 11, which can be a standard microcontroller. Similarly, the controller in the form of processor 21 can be incorporated with a standard microcontroller.

In the following, an explanation will be given regarding the traffic jam predicting method of the present invention in a given environment. Usually, no roads are jammed throughout the day or throughout the year, so that there is no problem if the traffic jam can be eliminated. In this embodiment, as listed in Table 2, on the basis of the average speed of the link provided by traffic information center 20 the traffic states of links are classified to four steps.

TABLE 2

| Code | Average speed range (km/h) | Traffic state |
|---|---|---|
| S1 | $45 \leqq V$ | Fluid |
| S2 | $20 \leqq V < 45$ | Fluid → Traffic jam |
| S3 | $0 \leqq V < 20$ | Traffic jam |
| S4 | $20 \leqq V < 45$ | Traffic jam → Fluid |

Figure 2:
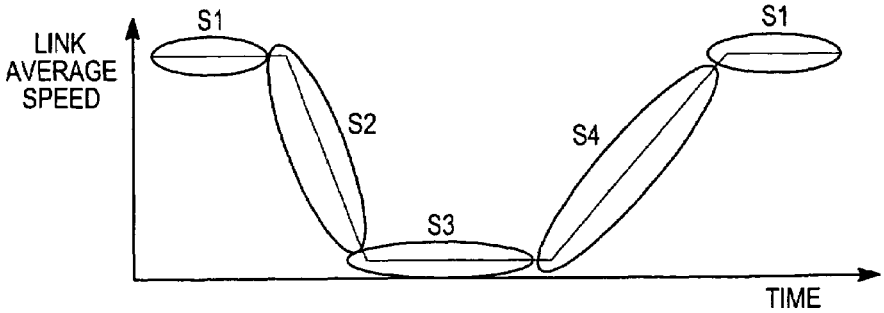
FIG. 2 is a diagram illustrating an example of the change in time of the link average speed.

FIG. 2 is a diagram illustrating an example of the change in the average speed of the link. Code S1 corresponds to the "fluid" traffic state with an average speed of 45 km/h or higher, and code S3 represents the "traffic jam" state with an average speed of 20 km/h or lower. On the other hand, codes S2 and S4 represent the traffic state in the speed range of 20-45 km/h. In code S2, the average speed of the current cycle is lower than that of the last cycle, that is, code S2 represents the traffic state of transition of "fluid→traffic jam" (traffic becoming jammed) with the average speed of link on the decrease. On the other hand, in code S4 the average speed of the current cycle is higher than that of the last cycle, that is, the average speed of the link is on the rise. It thus indicates the traffic state of transition from "traffic jam→fluid" (traffic jam is dissipating).

In the following, an explanation will be given regarding the method for predicting the current traffic state on the basis of the up-to-the-minute traffic jam information and the preceding traffic jam information received from traffic information center 20.

For the road link as the object of prediction of the traffic state, the average speed of the up-to-the-minute traffic jam information of the link is compared with the average speed of the preceding information. As a result, a judgment is made on the traffic state in the link according to Table 1 and FIG. 2, by example. If the link has an average speed of 45 km/h or higher for both the two succeeding cycles, it is assumed to be in a "fluid" state. If the link has an average speed of 20 km/h or lower for both the two succeeding cycles, it is assumed to be in a "traffic jam" state. Also, if the average speed is in the range of 20-45 km/h in both of the two succeeding cycles, and the average speed of the current cycle is lower than that of the last cycle, the link is designated with the state "fluid→traffic jam." On the other hand, if the average speed is in the range of 20-45 km/h in both of the two succeeding cycles, and the average speed of the current cycle is higher than that of the last cycle, the link is designated with the state "traffic jam→fluid."

If the average speed of the last cycle is 45 km/h or higher, and the average speed of the current cycle is lower than 45 km/h, it can be assumed to be in either the "fluid" state or the "fluid→traffic jam" state. On the other hand, if the average speed of the last cycle is lower than 20 km/h, while the average speed of the current cycle is 20 km/h or higher, the link may be in either a "traffic jam" state or a "traffic jam→fluid" state. For these reasons, when the traffic state of the link is judged from the average velocities in the two succeeding temporal cycles a hysteresis may be set in the change of the average speed to make a judgment.

In the object region for prediction of the traffic state, judgment of the traffic state is performed with respect to all of the road links in the region, and the number of the links in each of the four traffic states is checked. The traffic state that has the largest proportion of the number of links in the traffic state with respect to the total number of links is taken as the current traffic state of the prediction object region. Also, the object region for prediction of the traffic state may be selected in any map region, such as the map region with the given vehicle at the center, the map region ahead of the given vehicle on the guiding path to the destination, or the map region around the destination, etc.

In this way, according to one embodiment it is possible to predict the current traffic state of any map region on the basis of the two cycles of traffic jam information succeeding in time, that is, the up-to-the-minute traffic jam information and the preceding traffic jam information. Consequently, even when there is a change in the road environment due to a new department store or a new railway station, it is still possible to make a correct prediction of the traffic state in a timely manner.

In the following, an explanation will be given regarding the method for correcting the average speed of the link corresponding to the traffic state of the link and to compute the correct average speed of the link. Suppose the traffic jam information for a link is of any of codes 71-73 listed in Table 1, and the traffic state of the link is predicted to be state S2, "fluid→traffic jam." Because the average speed is on the decrease, instead of the average speed the lower limit value of the speed range corresponding to each speed code is adopted as the average speed. For example, suppose the traffic jam information of the link in code 72 has the speed in the range of 25-35 km/h, and it is predicted that the traffic state of the link is in state S2, "fluid→traffic jam." Instead of the average speed of 30 km/h, the lower limit speed of 25 km/h of the speed range 25-35 km/h is taken as the average speed.

Also, suppose a certain link has the traffic jam information of one of codes 71-73 as listed in Table 1. When the traffic state of this link is predicted to be in state S4, "traffic jam fluid," because the average speed is on the rise, instead of the average speed the upper limit value of the speed range corresponding to each speed code is adopted as the average speed. For example, suppose the traffic jam information for the link reports a speed in the range of 25-35 km/h for code 72, and it is predicted that the traffic state of the link is in state S2, "traffic jam→fluid." Instead of the average speed of 30 km/h the upper limit speed of 35 km/h of the speed range 25-35 km/h is taken as the average speed.

Because there is a time lag in the traffic jam information distributed from traffic information center 20, for this average speed after correction, one may also adopt a scheme in which a time lag correction coefficient is multiplied for correction. This time lag correction coefficient may be set experimentally.

In this way, the link average speed corrected by predicting the traffic information is used in searching the shortest time path to the destination with onboard navigation device 10. Conventionally, because the average speed listed in Table 1 is used to search for the shortest time path, there is a significantly large error between the average speed and the actual link speed, and it is impossible to search for the shortest time path correctly. With the embodiments taught herein, however, it is possible to determine the correct average speed near the actual link speed. Consequently, it is possible to search the shortest time path to the destination correctly.

Figure 3:
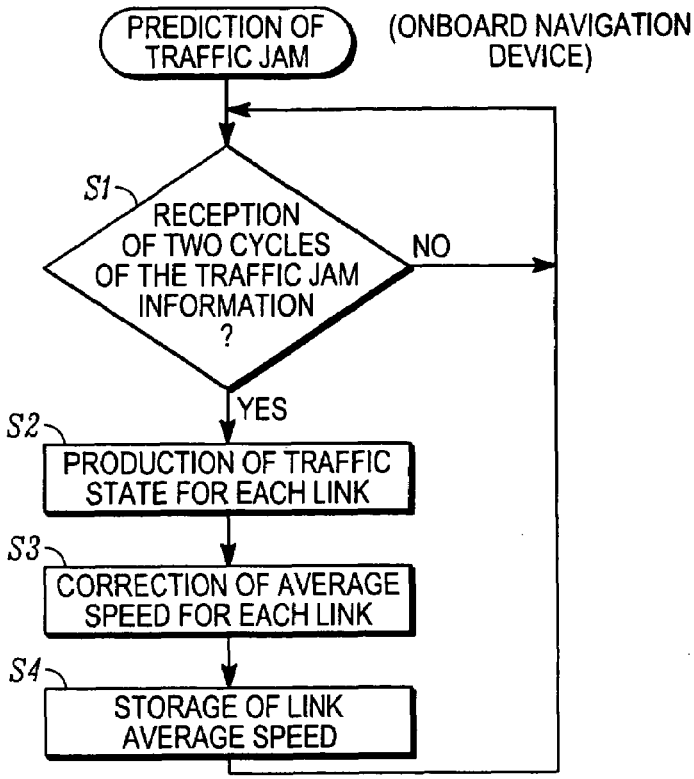
FIG. 3 is a flow chart illustrating the traffic jam prediction program in an embodiment.

FIG. 3 is a flow chart illustrating the traffic jam prediction program in an embodiment of the present invention. In the following, an explanation will be given regarding the traffic jam prediction operation of an embodiment by means of this flow chart. Navigation controller 11 of onboard navigation device 10 executes repeatedly said traffic jam prediction program when the ignition switch (not shown in the figure) is on using CPU 11A.

In step S1, whether the traffic jam information from traffic information center 20 is received two timed in two succeeding temporal cycles (e.g., about 5 min.) is checked. If the traffic jam information is received in two cycles, the process goes to step S2. In step S2, on the basis of the average speed of the up-to-the-minute traffic jam information and the preceding traffic jam information (see Table 1) the current traffic state for each link is predicted (see Table 2 and FIG. 2). Then, in step S3, on the basis of the traffic state of each link the average speed is corrected in the manner described above, and the average speed for each link is stored in traffic information storage device 16 in step S4.

As explained above, the traffic jam information from the traffic information center is received. On the basis of the up-to-the-minute traffic jam information and the change from the preceding traffic jam information, the current traffic state is estimated. On the basis of the up-to-the-minute traffic jam information and the current traffic state, the current average speed can be predicted for each link. Consequently, even when there is a change in the road environment, it is still possible to predict the traffic jam, and it is possible to make a correct prediction of the average speed for each link.

Also, on the basis of the up-to-the-minute traffic jam information and the change from the preceding traffic jam information a judgment is made regarding whether the current traffic state is fluid, is becoming jammed, is jammed, or is becoming un-jammed. Consequently, when the traffic state changes from the fluid state to the traffic jam state, or when the traffic state changes from traffic jam to fluid state, it is possible to understand the state. When the traffic state changes the average speed for each link can be predicted correctly.

In addition, with respect to the link average speed of the estimation result, the time lag component when the distribution of the traffic jam information is made from the traffic information center can be corrected. Consequently, it is possible to predict the link average speed more accurately.

Modifications to these embodiments are, of course, possible. For example, in the embodiments described, the traffic jam information from traffic information center 20 is received, and the traffic jam is predicted using onboard navigation device 10. However, traffic information center 20 can also collect the traffic jam information sent from the various vehicles, and on the basis of the two succeeding temporal cycles of traffic jam information the traffic jam state can be predicted by the traffic information center 20. On the basis of the traffic state of the prediction result, the corrected link average speed can then be distributed to the various vehicles. This modified example can be constructed in the same fashion as the embodiment shown in FIG. 1. The only changes would be to the programming for the respective processors 11A, 21.

Figure 4:
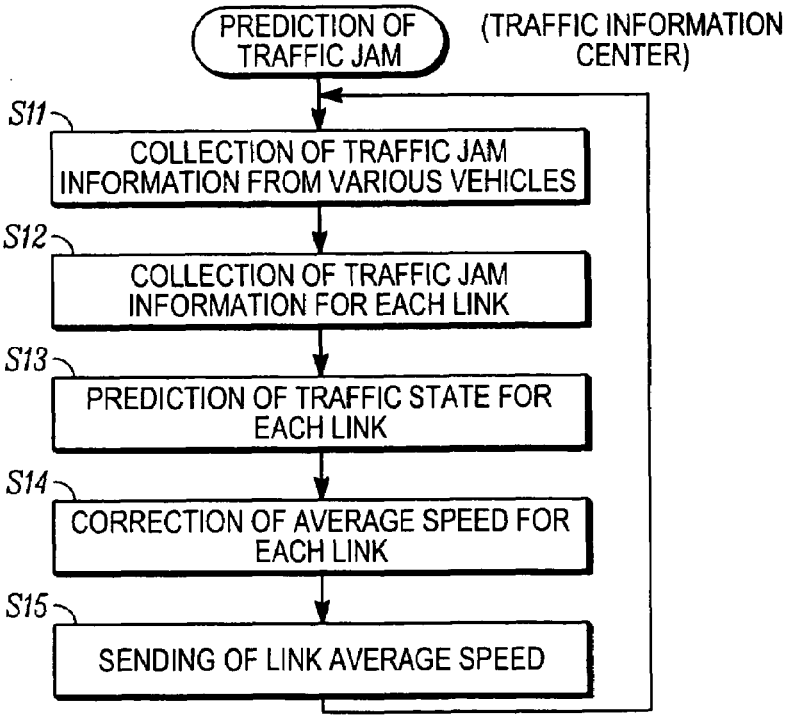
FIG. 4 is a flow chart illustrating the case when traffic jam prediction is performed in the traffic information center.

FIG. 4 is a flow chart illustrating the traffic jam prediction program when prediction of a traffic jam is performed by traffic information center 20. Onboard navigation device 10 computes the average speed for each road link by detecting the travel speed determined using a vehicle speed sensor (not shown), converts it to the speed code listed in Table 1, and sends the result to traffic information center 20. Traffic information center 20 collects the traffic jam information from the various vehicles in step S11.

In step S12, the traffic jam information sent from the various vehicles is collected for each road link. Then, in step S13, on the basis of the average speed of the up-to-the-minute traffic jam information and the preceding traffic jam information (see Table 1) as explained above the current traffic state for each link is predicted (see Table 2 and FIG. 2). Then, in step S14, on the basis of the traffic state for each link as explained above, the average speed is corrected. In step S15, the corrected link average speed is distributed to the various vehicles. In each vehicle, the link average speed received from traffic information center 20 is stored in traffic information storage device 16, and it is used for searching the shortest time path to the destination according to known methods.

In this way, the traffic jam degree for each road link is received from plural vehicles, and they are collected to generate the traffic jam information for distribution to the various vehicles. In the information center performing this operation, on the basis of the generated up-to-the-minute traffic jam information and the change from the preceding traffic jam information, the current traffic state is estimated. On the basis of the up-to-the-minute traffic jam information and the current traffic state, the current traffic jam degree is predicted. Consequently, even when the road environment is changed, it is still possible to predict the traffic jam, and it is still possible make a correct prediction of the average speed for each link.

Also, in each of these embodiments, on the basis of the traffic jam information of two succeeding temporal cycles, the traffic state for each link is predicted. One may optionally adopt a scheme in which the traffic jam information of three or more succeeding temporal cycles is used to predict the traffic state using the least squares method or the like.

The speed range and average speed for each speed code of the traffic jam information are not limited to those listed in Table 1. Also, classification of the traffic states is not limited to those listed in Table 2.

In these various embodiments, the explanation was based on the example in which the average speed for each link is used as a measure of the degree of traffic jam. However, one may also consider other variables, such as the travel time for each link, to be used as an indicator of the degree of traffic jam. With the teachings herein as a guide, one skilled in the art would be able to implement such a scheme. In this scheme, the same effects as those realized in the described embodiments can be obtained.

This application is based on Japanese Patent Application No. 2005-189702, filed Jun. 29, 2005, in the Japanese Patent Office, the entire contents of which are hereby incorporated by reference.

Also, the above-described embodiments have been described in order to allow easy understanding of the present invention and do not limit the present invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A traffic jam prediction device receiving traffic jam information from a traffic information center, the device comprising:

a controller configured to sample current traffic jam information for at least two successive temporal cycles, to estimate a current traffic state of a road link based on first current traffic jam information of a most recent temporal cycle and a change between the first current traffic jam information of the most recent temporal cycle and a second current traffic jam information from at least a temporal cycle preceding the most recent temporal cycle, and to predict a current traffic jam degree of the road link based on the first current traffic jam information and the current traffic state as estimated.

2. The traffic jam prediction device according to claim 1, further comprising:

at least one communication link between the traffic information center and a plurality of onboard navigation devices, each of the plurality associated with a respective vehicle; and wherein the traffic information center is configured to obtain, from each of the plurality of onboard navigation devices, a respective traffic jam degree for a road link on which each of the plurality of onboard navigation devices is traveling, the respective traffic jam degree based on at least one of an average speed and an average travel time of the road link, and wherein the traffic information center is configured to generate the traffic jam information for at least one vehicle using the respective traffic jam degree.

3. The traffic jam prediction device according to claim 2 wherein the traffic information center includes the controller.

4. The traffic jam prediction device according to claim 2 wherein each of the plurality of onboard navigation devices includes a respective controller configured to sample the current traffic jam information for at least two successive temporal cycles, to estimate the current traffic state of the road link based on the first current traffic jam information of the most recent temporal cycle and the change between the first current traffic jam information of the most recent temporal cycle and the second current traffic jam information from the at least the temporal cycle preceding the most recent temporal cycle, and to predict the current traffic jam degree of the road link based on the first current traffic jam information and the current traffic state as estimated.

5. The traffic jam prediction device according to claim 1, further comprising:

an onboard navigation device housing the controller.

6. The traffic jam prediction device according to claim 1 wherein the controller is configured to predict a current average speed of the road link based on the first current traffic jam information and the current traffic state as estimated, the current average speed representing the current traffic jam degree.

7. The traffic jam prediction device according to claim 1 wherein the controller is configured to predict a current travel time for the road link based on the first traffic jam information and the current traffic state as estimated, the current travel time representing the current traffic jam degree.

8. The traffic jam prediction device according to claim 1 wherein the current traffic state is one of fluid, becoming jammed, jammed and becoming less jammed.

9. The traffic jam prediction device according to claim 1 wherein the controller is further configured to correct a time delay with respect to the current traffic jam degree of the road link based upon a time needed to transmit the traffic jam information from the traffic information center.

10. A traffic jam prediction device, comprising:

traffic state sampling means for sampling current traffic jam information for at least two successive temporal cycles;

traffic state estimating means for estimating a current traffic state of a road link based on first current traffic jam information of a most recent temporal cycle and a change between the first current traffic jam information of the most recent temporal cycle and a second current traffic jam information from at least a temporal cycle preceding the most recent temporal cycle; and traffic jam degree predicting means for predicting of a current traffic jam degree of the road link based on the first current traffic jam information and the current traffic state from the traffic state estimating means.

11. A traffic jam prediction method, comprising:

sampling current traffic jam information for at least two successive temporal cycles;

estimating a current traffic state of a road link using a controller, the current traffic state estimated based on first current traffic jam information of a most recent temporal cycle and a change between the first current traffic jam information of the most recent temporal cycle and a second current traffic jam information from at least a temporal cycle preceding the most recent temporal cycle; and predicting a current traffic jam degree of the road link using the controller, the current traffic jam degree predicted based on the first current traffic jam information and the current traffic state of the road link.

12. The traffic jam prediction method according to claim 11, further comprising:

receiving the traffic jam information from a traffic information center.

13. The traffic jam prediction method according to claim 12, further comprising:

receiving a traffic jam degree for respective road links at a traffic information center;

generating the traffic jam information at the traffic center; and transmitting the traffic jam information to respective onboard navigation devices.

14. The traffic jam prediction method according to claim 11 wherein predicting of the current traffic jam degree comprises predicting a current average speed based on the first current traffic jam information and the current traffic state.

15. The traffic jam prediction method according to claim 11 wherein the current traffic state comprises one of fluid, becoming jammed, jammed and becoming less jammed.

16. The traffic jam prediction method according to claim 11 wherein predicting of the current traffic jam degree comprises predicting a current travel time based on the first traffic jam information and the current traffic state.

17. The traffic jam prediction method according to claim 11, further comprising:

correcting a time delay with respect to the current traffic jam degree based upon a time needed to transmit the traffic jam information from a traffic information center.

18. The traffic jam prediction method according to claim 11 wherein estimating the current traffic state comprises comparing a first speed of the road link to a second, subsequent speed of the road link; and wherein a result of comparing provides the current traffic state of the road link.

19. The traffic jam prediction method according to claim 18 wherein the current traffic jam information is a projected average speed for the road link and the first current traffic jam information is a first projected average speed for the road link; and wherein predicting the current traffic jam degree comprises revising the first projected average speed for the road link based on the current traffic state.

20. The traffic jam prediction method according to claim 11 wherein the current traffic jam information is a projected average speed for the road link and the first current traffic jam information is a first projected average speed for the road link; and wherein predicting the current traffic jam degree comprises revising the first projected average speed for the road link based on the current traffic state.

* * * * *